US007975390B2

(12) United States Patent
Goonetilleke et al.

(10) Patent No.: US 7,975,390 B2
(45) Date of Patent: Jul. 12, 2011

(54) METHOD AND APPARATUS FOR DETERMINING FLARE ON FOOT AND SHOE-LAST

(75) Inventors: Ravindra Stephen Goonetilleke, Kowloon (HK); Channa Patuwatha Witana, Kowloon (HK)

(73) Assignee: The Hong Kong University of Science and Technology, Hong Kong (CN)

( * ) Notice: Subject to any disclaimer, the term of this patent is extended or adjusted under 35 U.S.C. 154(b) by 24 days.

(21) Appl. No.: 12/369,244

(22) Filed: Feb. 11, 2009

(65) Prior Publication Data

US 2009/0205213 A1 Aug. 20, 2009

Related U.S. Application Data

(60) Provisional application No. 61/065,929, filed on Feb. 19, 2008.

(51) Int. Cl.
*A43D 1/00* (2006.01)
*A61B 5/107* (2006.01)

(52) U.S. Cl. ..... 33/3 B; 33/515

(58) Field of Classification Search ..... 33/3 R, 33/3 A, 3 B, 3 C, 511, 512, 515
See application file for complete search history.

(56) References Cited

U.S. PATENT DOCUMENTS 2,758,376 A * 8/1956 Ledos ..... 33/3 C
2,841,878 A * 7/1958 Woodman ..... 33/3 A
3,432,928 A * 3/1969 Rice ..... 33/3 B
5,128,880 A * 7/1992 White ..... 33/512
6,160,264 A * 12/2000 Rebiere ..... 250/559.22
7,707,742 B2 * 5/2010 Ellis, III ..... 36/25 R
2002/0092182 A1 * 7/2002 Coplon et al. ..... 33/3 A
2006/0032086 A1 * 2/2006 Ellis ..... 36/25 R

OTHER PUBLICATIONS

Goonetilleke et al; Foot Flare and Foot Axis; Dec. 1999; pp. 596-607; vol. 41, No. 4; Human Factors.

Freedman et al; Foot Dimensions of Soldiers (Third Partial Report Project No. T-13); Mar. 11, 1946; pp. 80-87; Armored Medical Research Laboratory; Fort Knox, Kentucky.

Yavatkar; Computer Aided System Approach to Determine the Shoe-Last Size and Shape Based on Statistical Approximated Model of a Human Foot. Unpublished Master's Thesis; 1993; pp. 52-67; Tufts University, Medford, MA.

* cited by examiner

*Primary Examiner* — G. Bradley Bennett
(74) *Attorney, Agent, or Firm* — Leydig, Voit & Mayer, Ltd.

(57) ABSTRACT

A method and apparatus for determining the critical foot and shoe-last dimensions and variables is provided. The apparatus includes a surface for a foot to stand on, a mechanism to determine the axis passing through heel centerline, a mechanism to determine the foot or shoe last width measurement, a mechanism to determine the axis passing through center of the foot (or last) width, a mechanism to determine the mid-foot height and a mechanism to determine heel width. Based on the above mentioned mechanisms, the apparatus can determine the required dimensions and the curvature of a person's foot, called the flare angle, and as well as the curvature of a shoe-last so that footwear fitting can be improved.

26 Claims, 14 Drawing Sheets

METHOD AND APPARATUS FOR DETERMINING FLARE ON FOOT AND SHOE-LAST

CROSS REFERENCE TO RELATED APPLICATIONS

This application claims benefit of U.S. Provisional Application No. 61/065,929 filed Feb. 19, 2008.

FIELD OF THE INVENTION

The present invention relates to an apparatus that can be used for the determination of the critical dimensions and the angle, called flare, of regular or irregular objects, including in particular foot shapes and shoe-last shapes.

BACKGROUND OF THE INVENTION

Most commercial footwear are designed and manufactured on a curved shoe-last, although the amount of curvature of the shoe-last and the turning point of the shoe-last centerline have not been well defined. This longitudinal shoe-last curvature or so called "flare" is a critical design feature for a shoe since it has to be compatible with the wearer's foot curvature in order to produce the right fit and comfort. Foot flare has been defined in several different ways, and each definition is based on a different measurement. Foot flare angle defined by Yavatkar (1993), involves angular measurement, which is itself specified according to different reference points and is the same for a last as well. As shown in FIG. 1 the flare angle β is measured from the reference heel centerline HL to the toe centerline HM. The heel centerline HL is obtained by joining the two center points of the lines located 10 mm and 50 mm from the pternion H. The points B and C correspond to the first and fifth toe projections and the toe centerline HM is obtained by joining the pternion H and the toe center M where BM=MC.

Another measurement for curvature is a foot flare ratio defined by Freedman et al. (1946), which utilizes the ratio between the perpendicular distance to the medial side of the first metatarsal (distance a) and the perpendicular distance to the lateral side of the fifth metatarsal (distance b) from the heel centerline HL (FIG. 1). The foot flare ratio is defined as a/(a+b).

Based on either of these definitions, the flare on a foot and a shoe-last can be determined. However, there is no such device available for such a measurement. There are many foot and shoe-last measuring devices such as the brannock, ritz stick, foot fitter, etc readily available in the market but all of them measure only linear dimensions. The present invention at least in its preferred forms allows a number of linear dimensions to be measured in addition to the flare angle.

SUMMARY OF THE INVENTION

According to the present invention there is provided apparatus for determining the flare of an object, comprising: (a) means for determining a first centerline extending from a first end of said object, (b) means for determining a second centerline extending from a second end of said object, and (c) means for determining the flare of said object by the angle between said first and second centerlines.

Preferably the means for determining said first centerline comprises a first pair of touch probes adapted to contact opposing sides of the first end of said object at a first location, and a second pair of touch probes adapted to contact opposing sides of the first end of said object at a second location wherein said first and second locations are spaced apart by a distance in the direction of said first centerline. In a preferred embodiment means are provided to adjust the distance by which said locations are spaced apart.

Preferably the means for determining said second centerline comprises a pair of touch probes adapted to move laterally with respect to said object and to contact opposing sides of said second end of said object. In a particularly preferred embodiment the means for determining said first centerline comprises a first pair of touch probes adapted to contact opposing sides of the first end of said object at a first location, and a second pair of touch probes adapted to contact opposing sides of the first end of said object at a second location, said first and second locations being spaced apart in the direction of said first centerline, wherein said means for determining said second centerline comprises a pair of touch probes adapted to contact opposing sides of said second end of said object, and wherein means are provided for pivotal movement between said means for determining the first centerline and said means for determining the second centerline. Preferably a display is provided for indicating the angular separation between said first centerline and said second centerline. A display means may also be provided to indicate when said touch probes are in contact with said object.

According to another aspect of the invention there is provided apparatus for determining the flare of an object, comprising: (a) means for determining a centerline extending from a first end of said object, and (b) means for determining the perpendicular distances from said centerline to first and second locations on opposing sides of said object.

Preferably the means for determining said centerline comprises a first pair of touch probes adapted to contact opposing sides of said first end of said object at a first location, and a second pair of touch probes adapted to contact opposing sides of said first end of said object at a second location wherein said first and second locations are spaced apart by a distance in the direction of said centerline. Preferably means are provided to adjust the distance by which said locations are spaced apart.

In preferred embodiments of the invention the means for determining the perpendicular distances of said first and second locations from said centerline comprises a pair of touch probes adapted to move perpendicularly with respect to said centerline. Preferably the touch probes are provided with displays indicating their distance from the centerline. Preferably the touch probes are adapted for movement in a direction parallel to said centerline.

Viewed from a still further aspect of the invention there is provided apparatus for determining the flare of an object, comprising: (a) means for determining a first centerline extending from a first end of said object, (b) means for determining a second centerline extending from a second end of said object, (c) means for determining the perpendicular distances from said first centerline to first and second locations on opposing sides of said object, and (d) means for determining the flare of said object either by the angle between said first and second centerlines or by said perpendicular distances.

Viewed from another broad aspect the present invention provides apparatus for obtaining measurements of an object from which the flare of an object can be determined, wherein said apparatus is capable of providing data from which both a flare angle and a flare ratio can be derived.

In all aspects of the invention the object may for example be a foot or a shoe-last and said first and second centerlines are respectively a heel centerline and a toe centerline, and said first and second locations are lateral and medial sides of metatarsals of a foot or corresponding locations of a shoe-last. However, embodiments of the invention may also be used to measure other objects.

BRIEF DESCRIPTION OF THE DRAWINGS

Some embodiments of the invention will now be described by way of example and with reference to the accompanying drawings, in which.

DETAILED DESCRIPTION OF PREFERRED EMBODIMENTS

It is important to be able to determine the flare in a foot and a shoe (or the shoe-last) in order to make their interaction compatible. The present invention at least in its preferred forms provides a device for determining the amount of longitudinal flare on a foot or a shoe-last using either of two known methods. In one method the flare on a foot or a shoe-last is measured as the ratio of metatarsal distances from the heel centerline using the definition of Freedman et al. In this method a foot flare ratio that is closer to 1 represents a higher inward flare and a value closer to 0 represents an outward foot flare. In the other method the foot or shoe-last flare is quantified as an angular measurement using the definition of Yavatkar. Embodiments of the invention can be used to determine the two axes of the foot; the heel centerline, and the toe centerline, wherein the flare angle is defined as the angle measured between them. These two centerlines pass through the same point pternion at the rearfoot. Apparatus according to embodiments of the invention can be used to measure any size of foot or shoe-last from US Child shoe size 6 to 13, US Men's shoe size 6 to 15, and US Women's shoe size 6 to 15.

Figure 1:
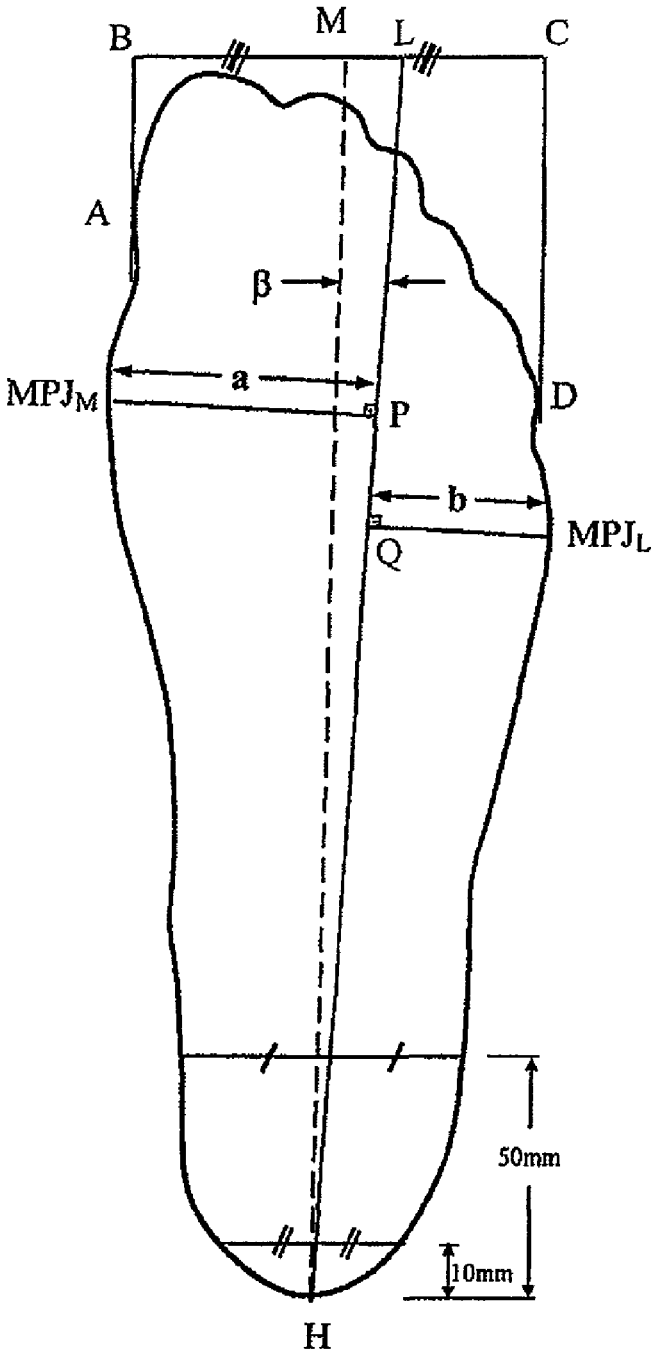
FIG. 1 illustrates the definition of foot flare angle and foot flare ratio.
Figure 2:
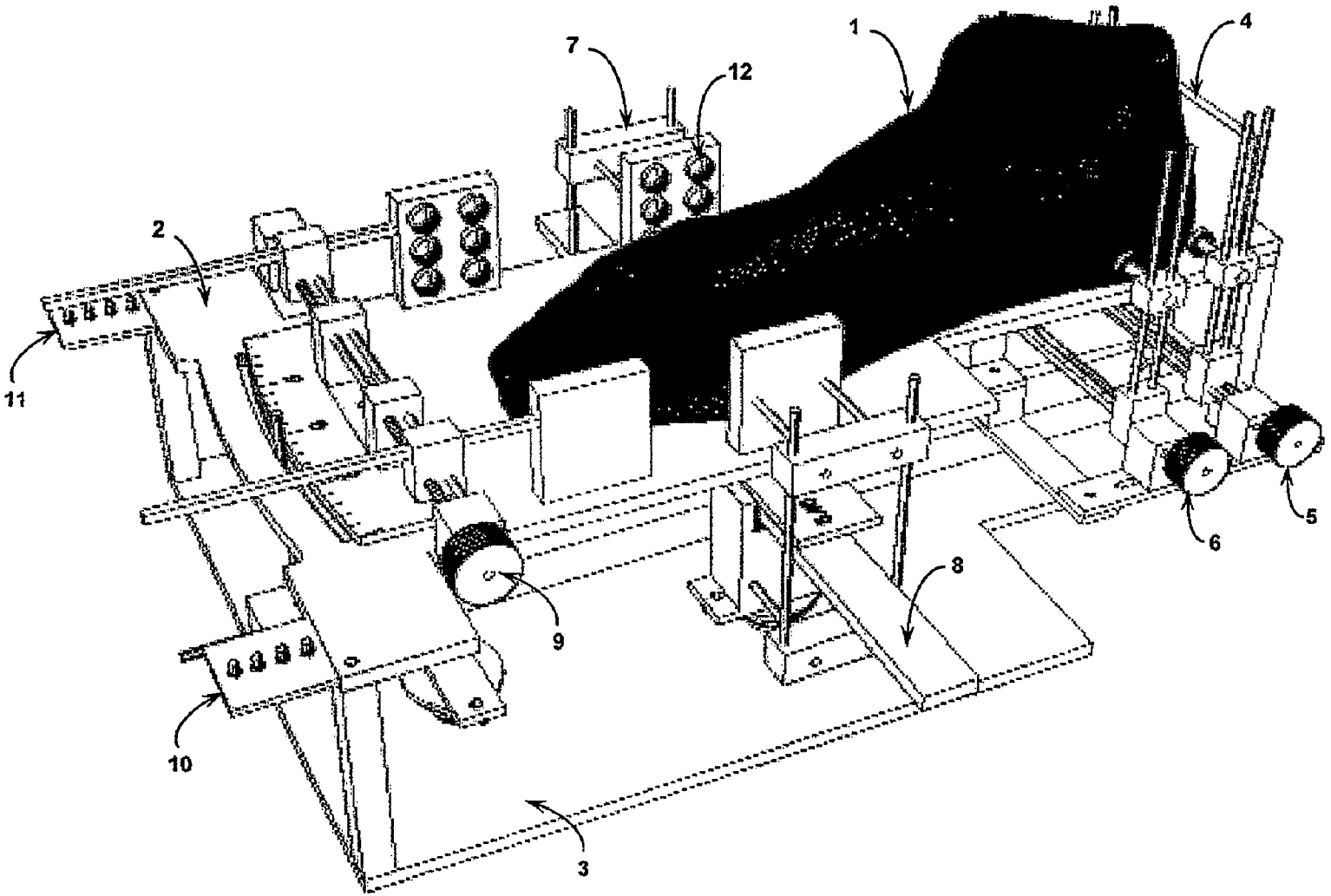
FIG. 2 is a side perspective view of an embodiment of the invention.
Figure 3:
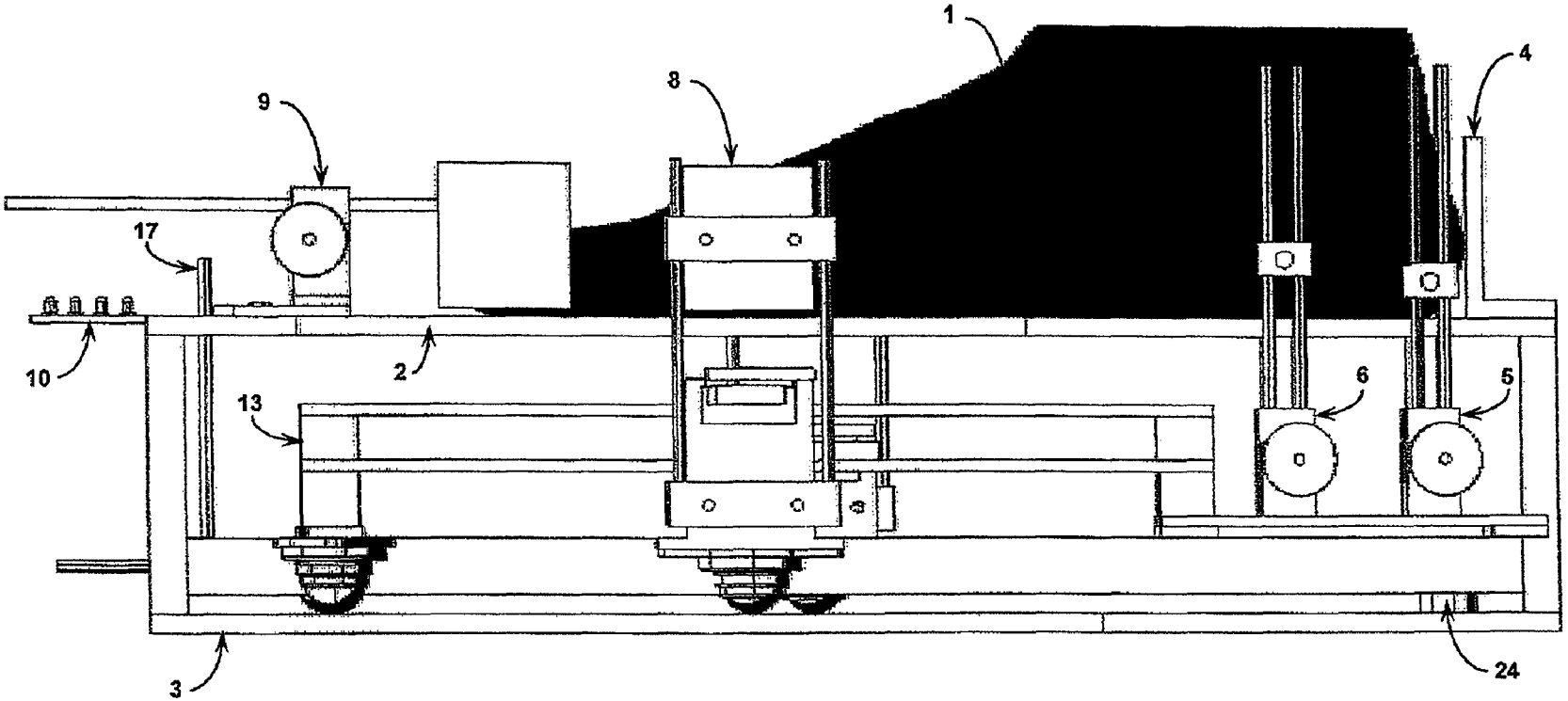
FIG. 3 is a side view of an embodiment of the invention.

Referring to the figures, more specifically FIG. 2 and FIG. 3, an apparatus for determining the amount of longitudinal flare on a foot or a shoe-last is schematically depicted. For the convenience of description in the remainder of this specification reference will only be made to a "foot" but it will be understood that the measurements could equally be applied to a shoe-last (and in the context of a shoe-last it will be understood that the terms "toe", "heel" and the like that refer to parts of a foot may also be used to refer to their equivalent locations on the shoe-last) or indeed to any regular or irregular object that has a longitudinal axis defining and first end and a second end and where the shape of the article is such that there exists a longitudinal flare that may be determined either by measuring flare angle or flare ratio. In the context of a foot or shoe-last the first end may be considered to be the heel and the second end may be considered to be the toes. The heel centerline may be considered to be the first centerline, and the toe centerline may be considered to be the second centerline.

Figure 10:
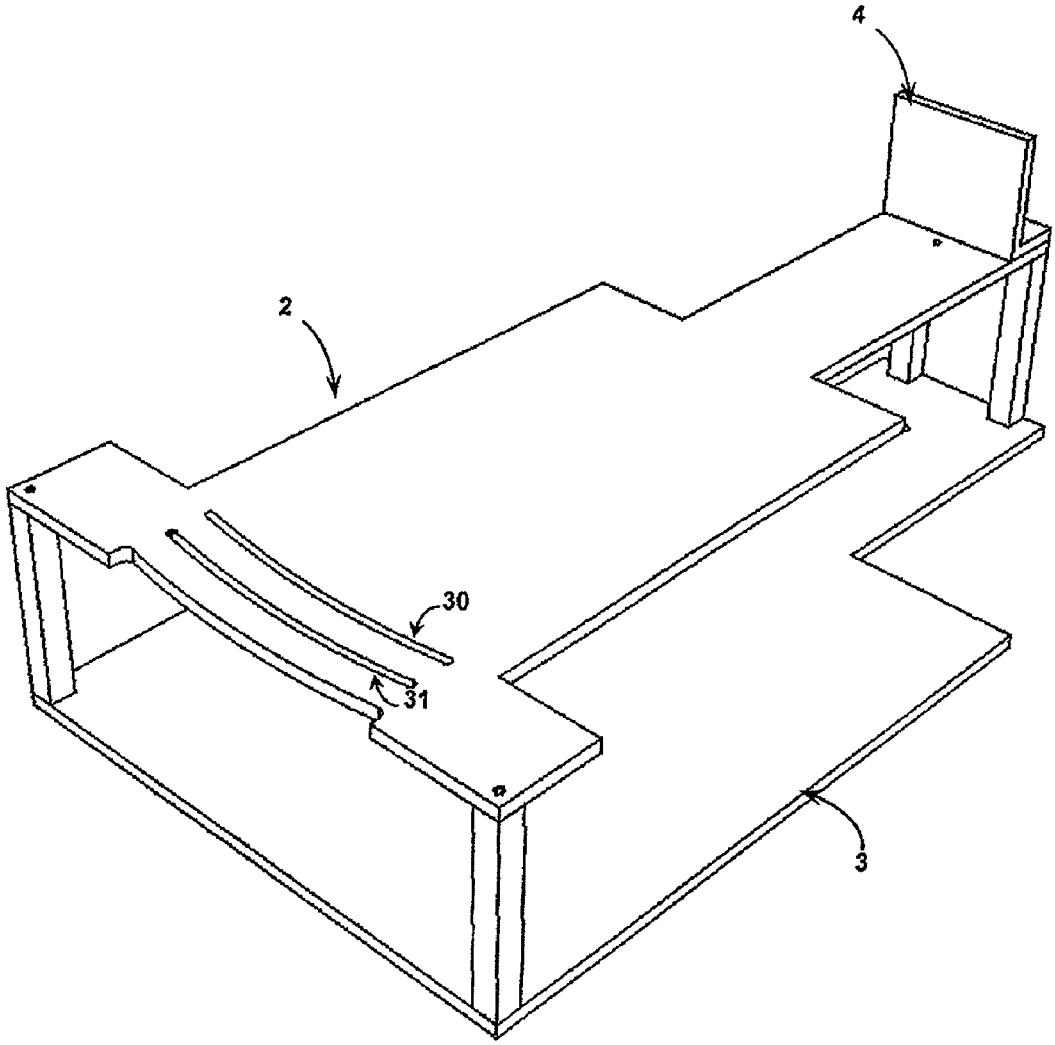
FIG. 10 is a side perspective view of lower and upper bases forming part of an embodiment of the invention.

According to a preferred embodiment of the invention the apparatus comprises two mechanisms to measure the flare of a person's foot in a longitudinal direction. The apparatus comprises an upper base 2 and a lower base 3 and a person stands with foot 1 on the upper base 2 and the pternion of the foot 1 touching the heel stopper 4 which is rigidly fixed to the upper base 2. As will be explained in more detail below two heel center locating mechanisms 5, 6 and medial and lateral metatarsal distance measuring mechanisms 7, 8 are attached to a pivotable frame 13 while the whole assembly rests on the lower base 3 and is free to rotate around pivot 24 as shown in FIG. 3. The mechanism for locating the toe centerline 9 is mounted on upper base 2 and can slide side-ways across the width of the foot 1 along a curved slot 31 (FIG. 10). The heel center locating mechanisms 5 and 6, medial and lateral metatarsal distance measuring mechanisms 7, 8 and the toe centerline locating mechanism 9 are all respectively provided with touch sensors 12 that detect when the said mechanisms are in contact with the foot surface during measurement. Touch-indicators 10 and 11, are provided and which show which mechanisms are in contact with the foot and which mechanisms are not at any given time. In the embodiment shown in FIG. 5 the indicators are provided as displays at the toe end of the apparatus, but alternatively they may be provided as individual indicator lights associated with each touch sensor. The medial and lateral metatarsal distance measuring mechanisms 7, 8 are also provided with digital displays 14, 15 which display to a user the distance of the respective metatarsal touch indicators from the heel centerline.

Figure 4:
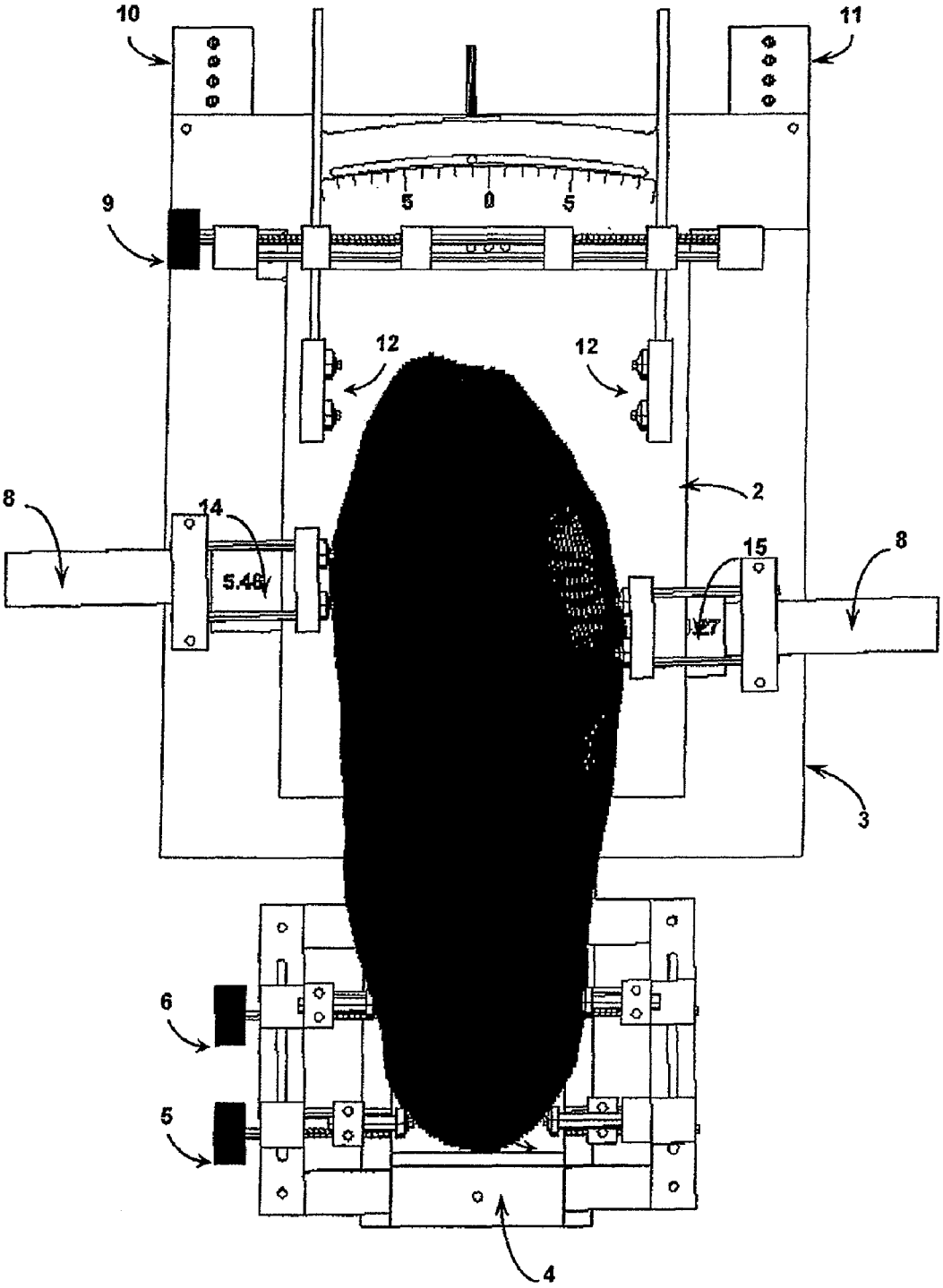
FIG. 4 is a top view of an embodiment of the invention illustrating the use of the embodiment for foot flare ratio measurement.

FIG. 4 shows how the embodiments of FIGS. 2 and 3 may be used to measure the foot flare ratio as defined by Freedman et al. The foot 1 is positioned on the upper base 2 such that the pternion of the foot touches the heel stopper 4 with the forefoot towards the toe centerline locating mechanism 9. The two heel centerline locating mechanisms, 5 and 6, are located at a distance of 10 mm and 50 mm (or at some other suitable distance) in front of the pternion respectively. To determine the heel centerline the locating mechanisms 5 and 6 are brought into contact with the heel by turning control knobs 25 (FIG. 9) such that the touch probes are moved into contact with the heel. Once the heel centerline is determined, the perpendicular distances to the medial side of the $1^{st}$ metatarsal, and the lateral side of the $5^{th}$ metatarsal from the heel centerline are measured using the medial and lateral metatarsal distance measuring mechanisms 8 by moving inwards the metatarsals side locating mechanisms 7, 8 until their touch probes contact the foot. During this arrangement of the device (i.e. measuring foot flare ratio), the operator has to make sure that the two heel centerline locating mechanisms 5 and 6, and the metatarsal distance measuring mechanism 8 touch the person's foot such that the touch-indicators 10 and 11 light-up as shown in FIG. 4. Once the medial and lateral metatarsal distance measuring mechanisms 7, 8 are in contact with the foot, the distances a and b can be read from the digital displays 14, 15 and the flare ratio can be calculated.

Figure 5:
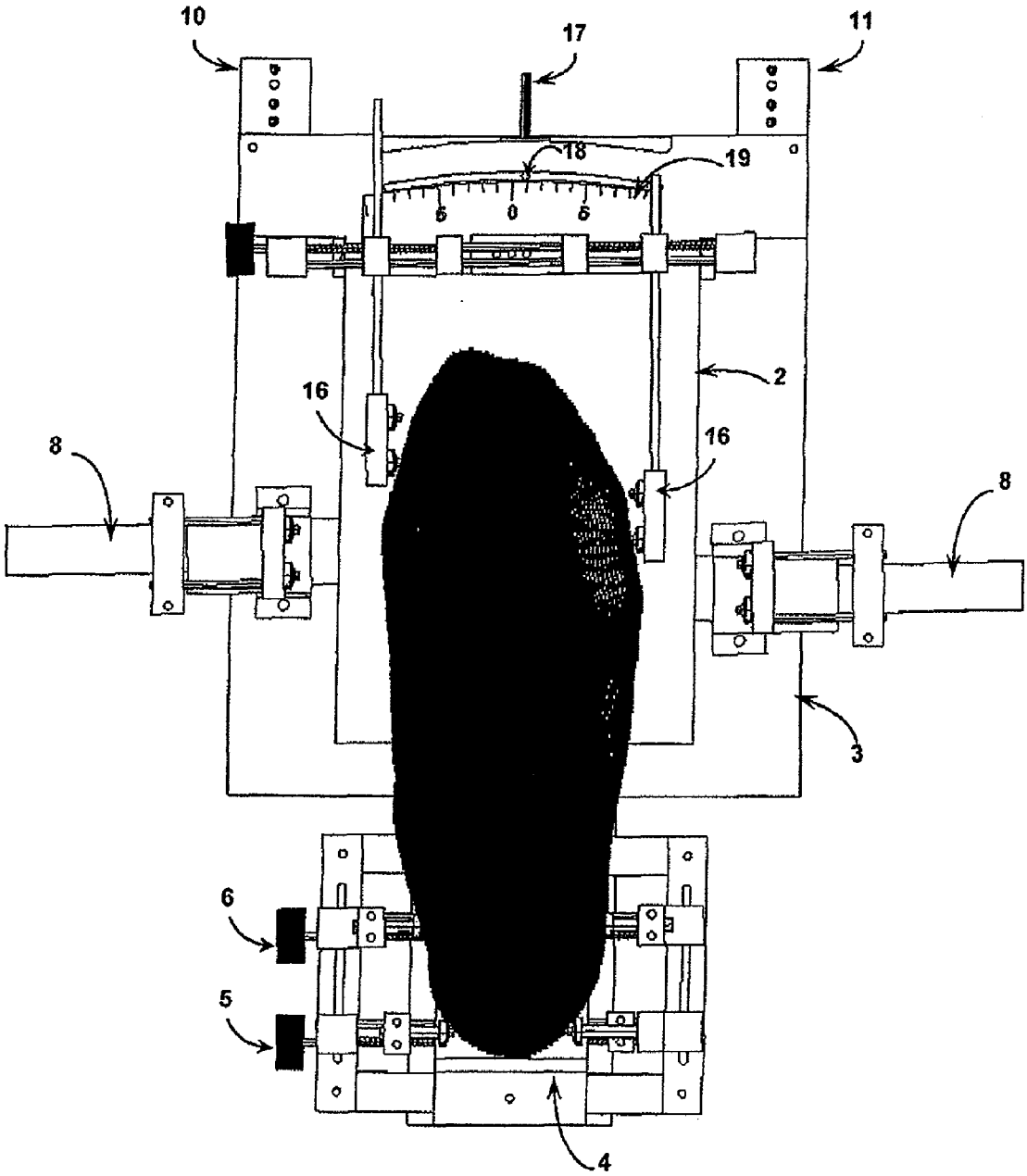
FIG. 5 is a top view of an embodiment of the invention illustrating the use of the embodiment for foot flare angle measurement.

FIG. 5 illustrates the arrangement for measuring foot flare angle using an embodiment of the invention. The foot 1 is positioned on the upper base 2 so that the pternion of the foot touches the heel stopper 4. The heel centerline of the foot is determined using of the heel centerline locating mechanisms, 5 and 6 as discussed above with reference to FIG. 4. The two heel centerline locating mechanisms, 5 and 6, are located at a distance of 10 mm and 50 mm or at a suitable distance in front of the pternion respectively. Once the heel centerline is fixed, the pointer 18 shows the direction of the heel centerline. Then the toe centerline of the foot is determined using the toe centerline locating mechanism, 9 by moving the medial and lateral jaws of the toe centerline locating mechanism, 16, until they contact respectively the medial and lateral sides of the forefoot. The toe centerline is then set to coincide with 0 degrees as shown on the angular display 19. The foot flare angle can be read from the angular display 19 by determining the angular displacement from the toe centerline (0 degree) to the heel centerline pointer 18. During this process of measuring foot flare angle, the operator should make sure that the two heel centerline locating mechanisms 5 and 6, and the medial and lateral jaws of the toe centerline locating mechanism 16 touch the person's foot such that the touch-indicators 10 and 11 should be lit-up as shown in FIG. 5. When measuring the foot flare angle using this embodiment, the metatarsal distance measuring mechanism 8, which is not required for the measurement of angle, can be positioned away from the foot to facilitate more room for operating other moving parts such as the medial and lateral jaws of the toe centerline locating mechanism 16 as illustrated in FIG. 5.

Indeed it will be understood that while in a preferred embodiment of the invention an apparatus is provided that is capable of measuring foot flare using both foot flare angle and foot flare ratio methods, a useful apparatus could still be obtained by either omitting the toe centerline locating mechanism or omitting the metatarsal measuring mechanism leaving an apparatus that can determining respectively foot flare ratio or foot flare angle only.

Figure 6:
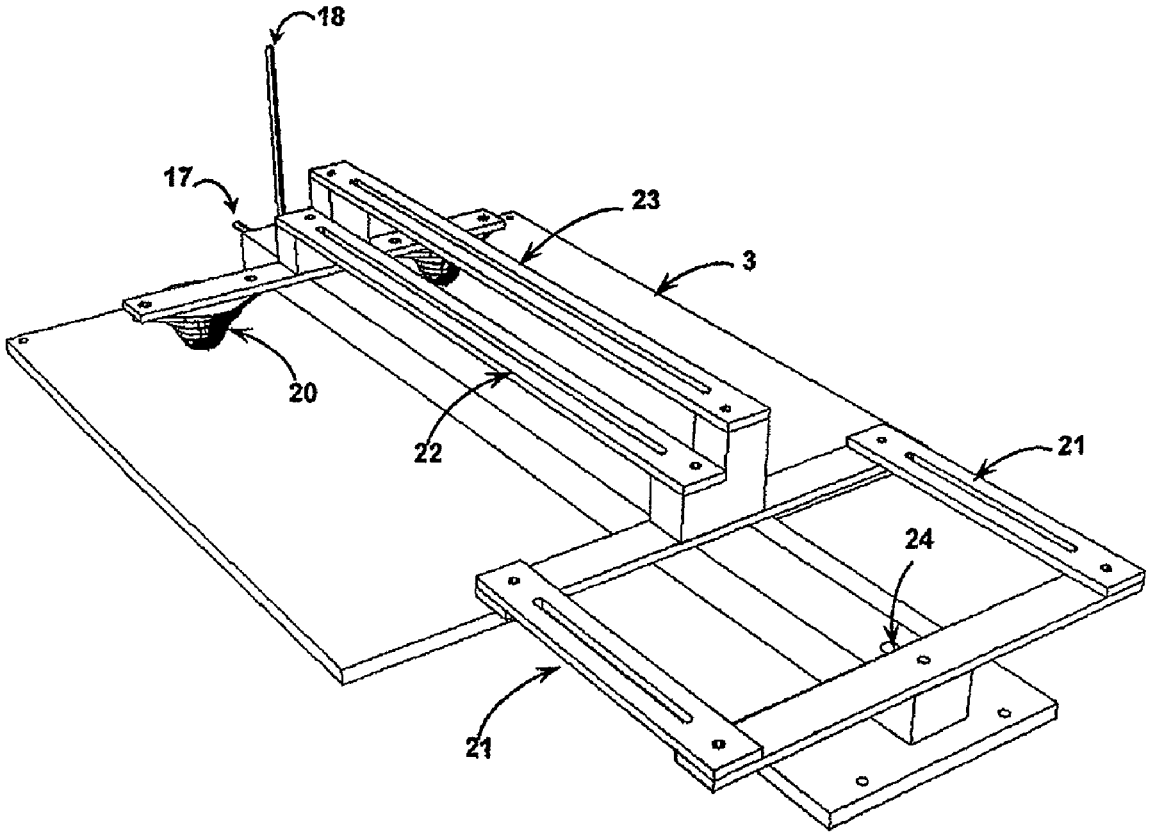
FIG. 6 is a side perspective view of a lower base and pivoted frame forming parts of an embodiment of the invention.
Figure 7:
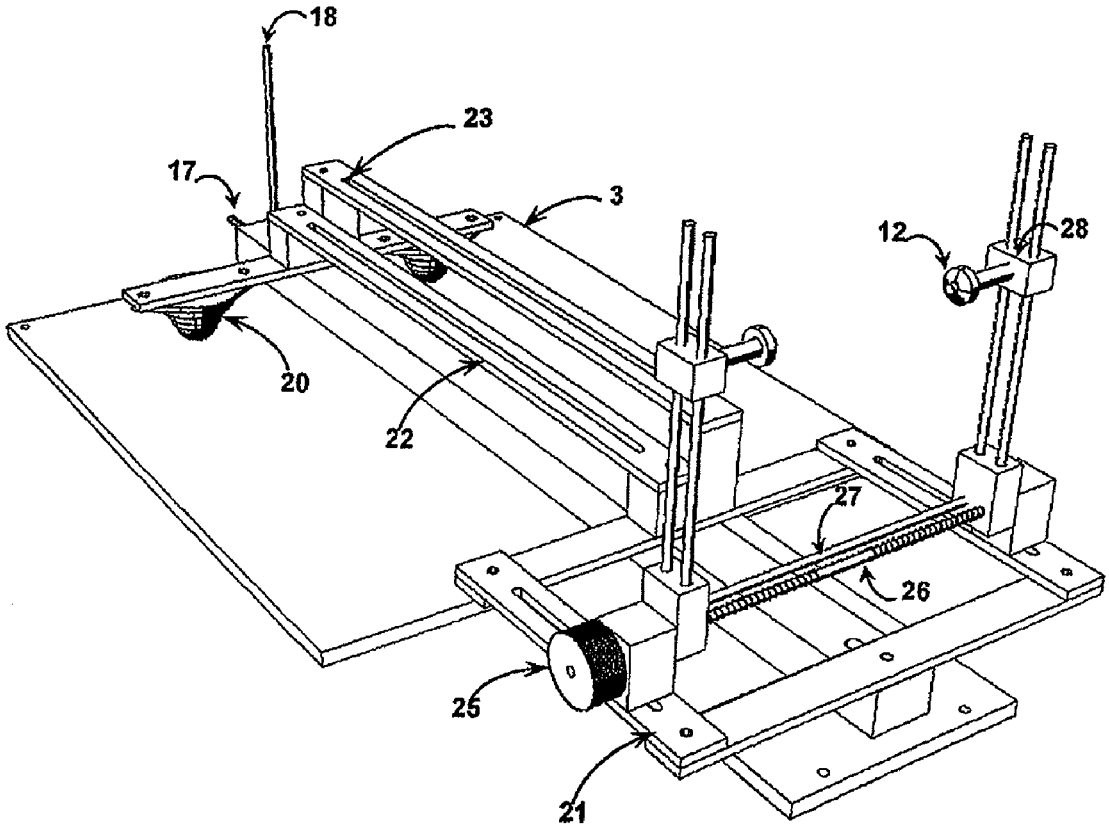
FIG. 7 is a side perspective view of the heel center locating mechanism in an embodiment of the invention.
Figure 8:
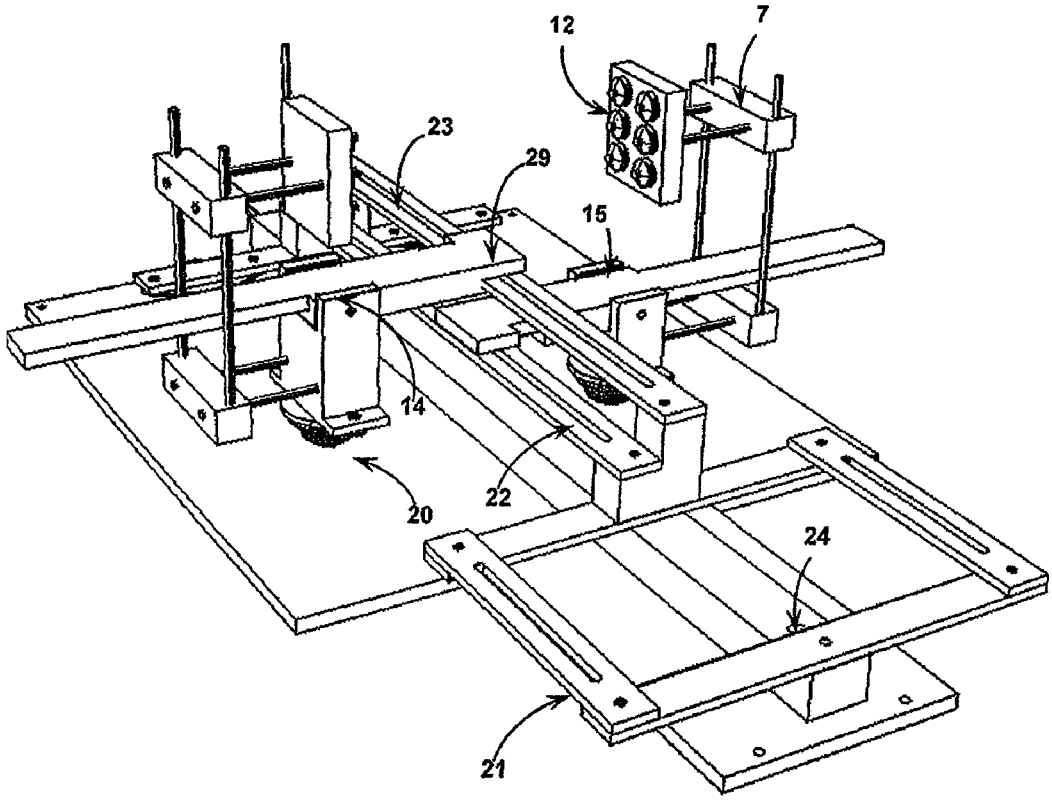
FIG. 8 is a side perspective view of a mechanism for measuring perpendicular distances to metatarsals in an embodiment of the invention.
Figure 9:
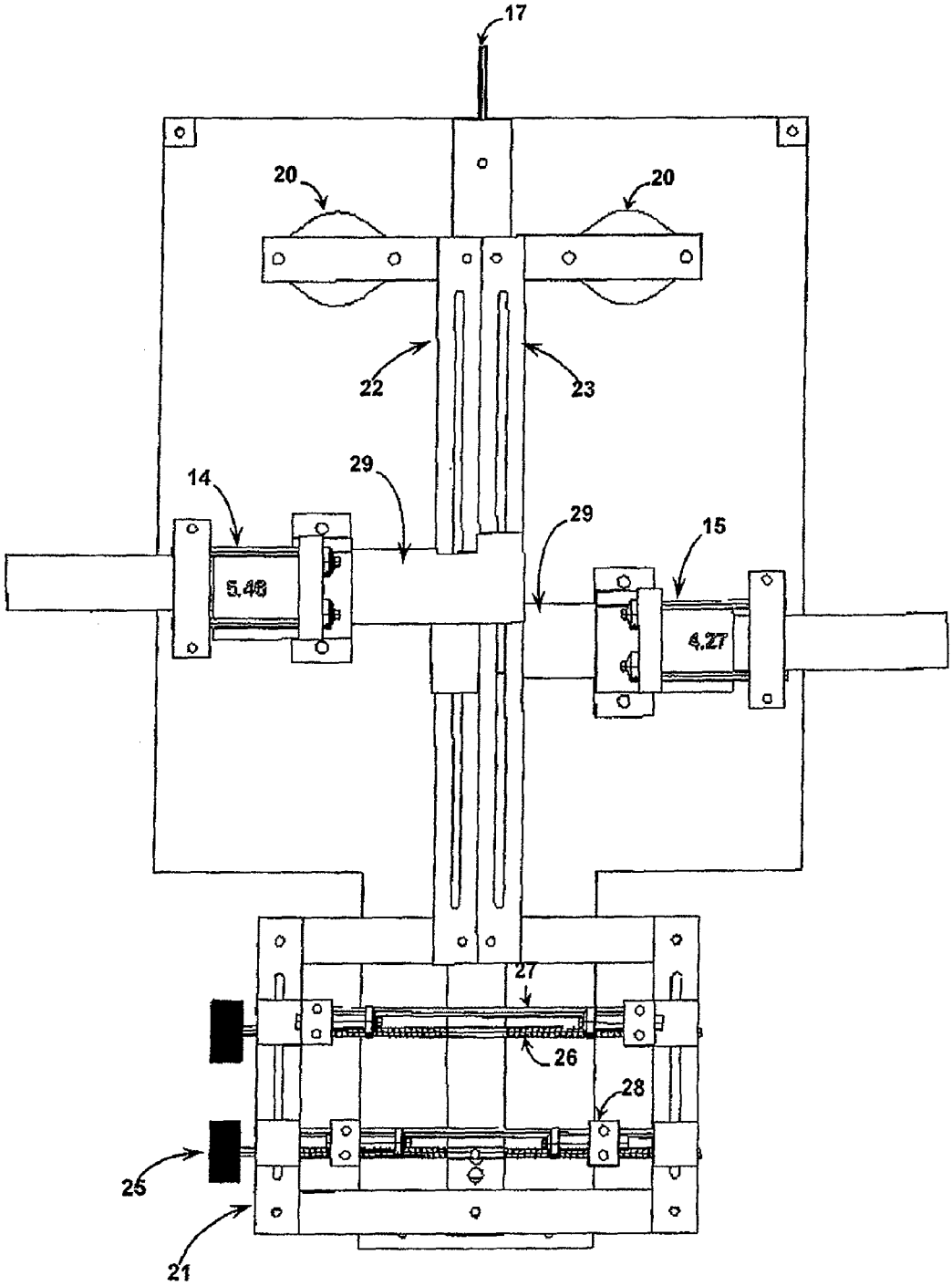
FIG. 9 is a top view of the mechanism for measuring perpendicular distances to metatarsals in an embodiment of the invention.

The majority of the components of the preferred embodiment are physically supported by the pivotable frame 13. As shown in FIG. 6, the pivotable frame has two slotted side bars 21 to facilitate movement of the heel centerline locating mechanisms 5 and 6 towards and away from the heel, and another two slotted bars 22 and 23 guide both the medial and lateral metatarsal distance measuring mechanisms 8 in a direction generally from heel to toe and vice versa. Slotted bars 22, 23 are provided with a vertical separation so that in use the two metatarsal distance measurement mechanisms do not interfere with each other. The whole frame rotates on pivot 24 at the rear-end with the front-end supported on two roller balls 20 for smooth movement on the lower base 3 and such that the movement of the lateral metatarsal distance measurement mechanisms is always perpendicular to the heel centerline. The heel centerline pointer 18 is fixed on to the front end of the pivoted frame as show in FIG. 6. When the heel centerline locating mechanisms 5 and 6 are mounted on the slotted side bars 21 the required positioning where 10 mm or 50 mm distance from the pternion can be provided by sliding the mechanism as a whole unit along the parallel slots 21 as illustrated in FIG. 7 (which for clarity shows only one of the locating mechanisms 5, 6). The heel centerline locating mechanism is designed with a bar containing right hand and left hand screws so that when the thumb wheel 25 rotates clock-wise, both the touch-probes mounted with touch sensors 12 move outwards and vice versa. The rod 27 serves as a guide. The height of the touch-probe can be adjusted by lifting or lowering the block 28 as shown in FIG. 7. FIG. 8 shows the working principle of the medial and lateral metatarsal distance measuring mechanisms 8. Guide-blocks 29 slide on the two slotted side bars 22 and 23 in a way that the metatarsal touching probes with the touch sensors 12 and distance displays 14 and 15 can move perpendicular to the heel centerline axis. The distances of the metatarsals from the heel centerline are shown in the displays 14 and 15 as illustrated in FIG. 9 so that the foot flare ratio can be calculated.

Figure 11:
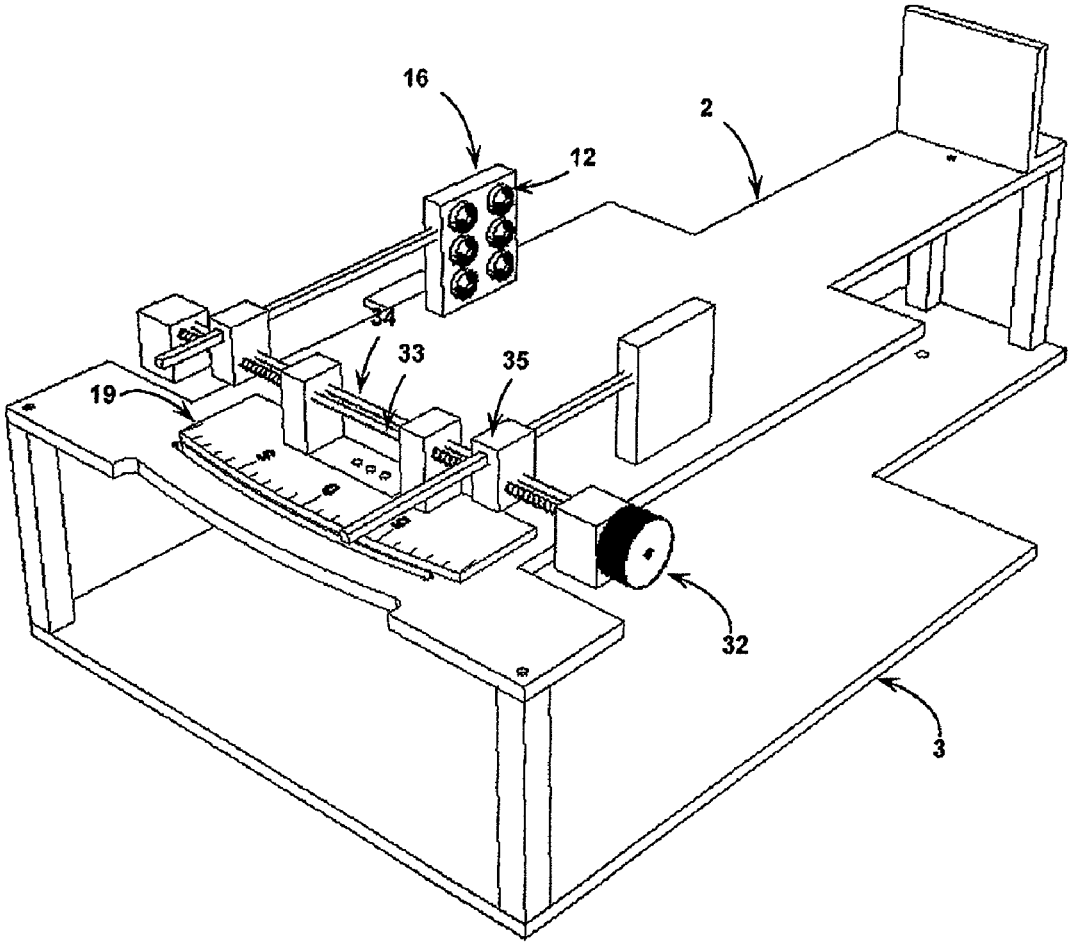
FIG. 11 is a side perspective view of a mechanism for locating the toe center line in an embodiment of the invention.

The upper base 2 is designed so that the foot 1 can rest on it. All the mechanisms are supported and operated on lower base 3 except the toe centerline locating mechanism 9. FIG. 10 shows a curved slot 30 that is used to guide the toe centerline locating mechanism 9. The center of the curve slot 30 is located at the middle of the heel stopper 4, where the pternion of the foot is located during measurement. A second curved slot 31 provides the space for the heel centerline pointer 18 to travel. As shown in FIG. 11, the toe centerline locating mechanism is designed with a shaft containing a right hand and a left hand screws so that when the thumb wheel 32 rotates clock-wise, the two blocks 35 attached with the medial and lateral jaws 16 and the touch sensors 12 move outwards and vice versa. The rod 34 acts as a guide. In order to locate the toe center, the whole unit has to slide medially and laterally on the slot 30 while changing the width of the medial and lateral jaws 16.

It will also be understood that in addition to determining foot flare as discussed above, the apparatus according to preferred embodiments of the invention could independently be used for measuring various dimensions of the foot including, but not limited to: foot or shoe-last length along a specified direction, foot or shoe-last width, arch length or heel to ball length of a foot, the width in the heel area of a shoe or last, mid-foot height of a foot, and big toe height of a foot.

Figure 12:
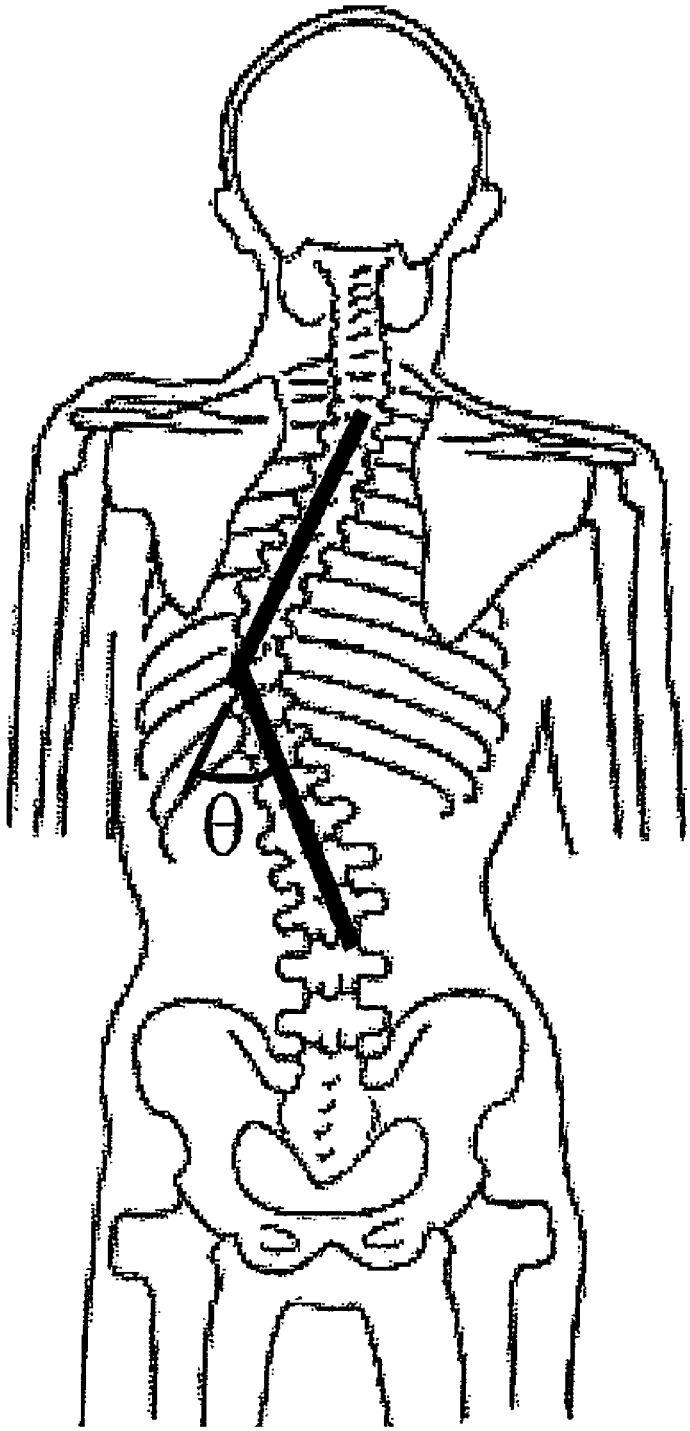
FIG. 12 shows how an embodiment of the invention could be used to measure the curvature of the spine.
Figure 13:
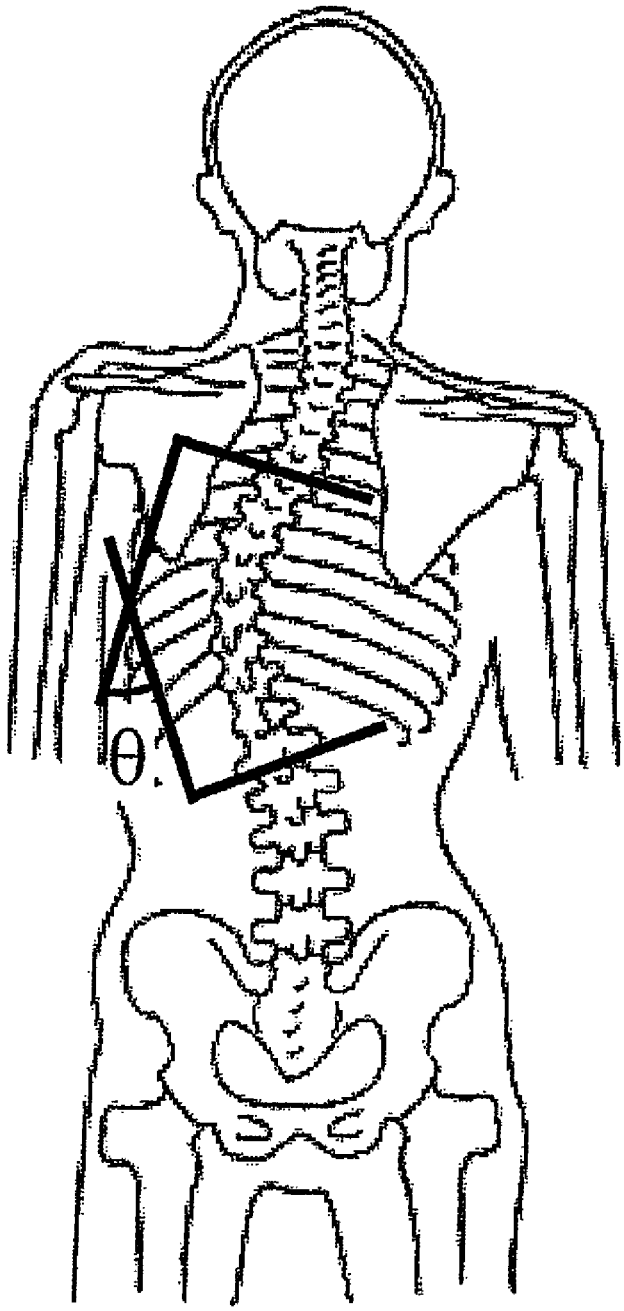
FIG. 13 shows another manner in which an embodiment of the invention could be used to measure the curvature of the spine.
Figure 14:
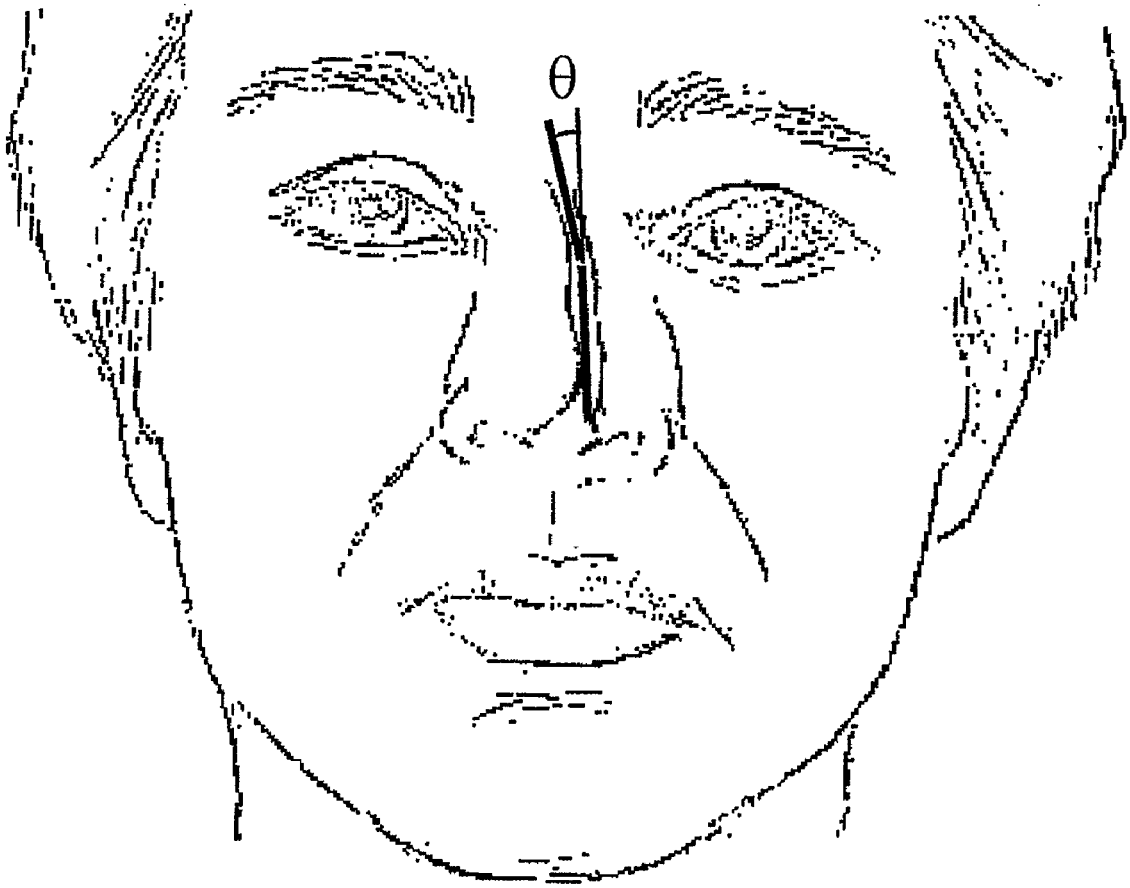
FIG. 14 shows how an embodiment of the invention could be used to measure the deviation of the septum.

It will also be understood that embodiments of the invention could be used to measure flare and other dimensions of other objects (including other parts of the body) including, but not limited to, a person's spine to determine the spinal curvatures for the evaluation of disease conditions such as scoliosis, a person's rear-foot curvature for assessing valgus and varus of the lower leg, and a person's nose for assessing deviated septum, which is a common cause of nasal obstruction. FIG. 12 for example shows how a curved spine could be viewed as two centerlines with an angle θ between them. The angle θ could be measured by an embodiment of the present invention in a similar manner to the flare angle of a foot. Alternatively, as shown in FIG. 13 the Cobb angle which is the angle defined between two lines drawn respectively parallel (or a lines drawn perpendicular to the parallel lines to the superior end plate of one vertebra and a parallel (or a line perpendicular to the parallel) to the inferior end plate of another vertebra. Again these lines (or their perpendicular lines) can be considered as centerlines and the Cobb angle measured as the angle θ between them. A similar procedure to locate the centerlines can be used to measure the amount of deviation of a person's septum as shown in FIG. 14.

The invention is not limited to the particular embodiments disclosed, but the invention will include all embodiments falling within the scope of the appended claims.

The invention claimed is:

1. Apparatus for determining the flare of an object, comprising:

(a) means for determining a first centerline extending from a first end of said object, (b) means for determining a second centerline extending from a second end of said object, and (c) means for determining the flare of said object by the angle between said first and second centerlines, wherein the flare of said object is a longitudinal curvature of said object.

2. Apparatus as claimed in claim 1 wherein said object is a foot or a shoe-last and said first and second ends are respectively a heel end and a toe end and first and second centerlines are respectively a heel centerline and a toe centerline.

3. Apparatus as claimed in claim 1 wherein said means for determining said first centerline comprises a first pair of touch probes adapted to contact opposing sides of the first end of said object at a first location, and a second pair of touch probes adapted to contact opposing sides of the first end of said object at a second location wherein said first and second locations are spaced apart by a distance in the direction of said first centerline.

4. Apparatus as claimed in claim 3 wherein means are provided to adjust the distance by which said locations are spaced apart.

5. Apparatus as claimed in claim 1 wherein said means for determining said second centerline comprises a pair of touch probes adapted to move laterally with respect to said object and to contact opposing sides of said second end of said object.

6. Apparatus as claimed in claim 1 wherein said means for determining said first centerline comprises a first pair of touch probes adapted to contact opposing sides of the first end of said object at a first location, and a second pair of touch probes adapted to contact opposing sides of the first end of said object at a second location, said first and second locations being spaced apart in the direction of said first centerline, wherein said means for determining said second centerline comprises a pair of touch probes adapted to contact opposing sides of said second end of said object, and wherein means are provided for pivotal movement between said means for determining the first centerline and said means for determining the second centerline.

7. Apparatus as claimed in claim 6 wherein a display is provided for indicating the angular separation between said first centerline and said second centerline.

8. Apparatus as claimed in claim 6 wherein a display means is provided to indicate when said touch probes are in contact with said object.

9. Apparatus for determining the flare of an object, comprising: (a) means for determining a centerline extending from a first end of said object, and (b) means for determining a flare ratio based on the perpendicular distances from said centerline to first and second locations on opposing sides of said object, wherein the flare of said object is a longitudinal curvature of said object.

10. Apparatus as claimed in claim 9 wherein said object is a foot or a shoe-last, said first end is a heel and said centerline is a heel centerline, and said first and second locations are lateral and medial sides of metatarsals of a foot or corresponding locations of a shoe-last.

11. Apparatus as claimed in claim 9 wherein said means for determining said centerline comprises a first pair of touch probes adapted to contact opposing sides of said first end of said object at a first location, and a second pair of touch probes adapted to contact opposing sides of said first end of said object at a second location wherein said first and second locations are spaced apart by a distance in the direction of said centerline.

12. Apparatus as claimed in claim 11 wherein means are provided to adjust the distance by which said locations are spaced apart.

13. Apparatus as claimed in claim 9 wherein said means for determining the perpendicular distances of said first and second locations from said centerline comprises a pair of touch probes adapted to move perpendicularly with respect to said centerline.

14. Apparatus as claimed in claim 13 wherein said touch probes are provided with displays indicating their distance from the centerline.

15. Apparatus as claimed in claim 13 wherein said touch probes are adapted for movement in a direction parallel to said centerline.

16. Apparatus for determining the flare of an object, comprising:

(a) means for determining a first centerline extending from a first end of said object, (b) means for determining a second centerline extending from a second end of said object, and (c) means for determining the perpendicular distances from said first centerline to first and second locations on opposing sides of said object, and (d) means for determining the flare of said object either by the angle between said first and second centerlines or by said perpendicular distances, wherein the flare of said object is a longitudinal curvature of said object.

17. Apparatus as claimed in claim 16 wherein said object is a foot or a shoe-last and said first and second centerlines are respectively a heel centerline and a toe centerline, and said first and second locations are lateral and medial sides of metatarsals of a foot or corresponding locations of a shoe-last.

18. Apparatus as claimed in claim 16 wherein said means for determining said first centerline comprises a first pair of touch probes adapted to contact opposing sides of said first end of said object at a first location, and a second pair of touch probes adapted to contact opposing sides of said first end of said object at a second location wherein said first and second locations are spaced apart by a distance in the direction of said first centerline.

19. Apparatus as claimed in claim 18 wherein means are provided to adjust the distance by which said locations are spaced apart.

20. Apparatus as claimed in claim 16 wherein said means for determining said second centerline comprises a pair of touch probes adapted to move laterally with respect to said object and to contact opposing sides of said second end of said object.

21. Apparatus as claimed in claim 16 wherein said means for determining said first centerline comprises a first pair of touch probes adapted to contact opposing sides of said first end of said object at a first location, and a second pair of touch probes adapted to contact opposing sides of said first end of said object at a second location, said first and second locations being spaced apart in the direction of said first centerline, wherein said means for determining said second centerline comprises a pair of touch probes adapted to contact opposing sides of said second end of said object, and wherein means are provided for pivotal movement between said means for determining the first centerline and said means for determining the second centerline.

22. Apparatus as claimed in claim 21 wherein a display is provided for indicating the angular separation between said first centerline and said second centerline.

23. Apparatus as claimed in claim 21 wherein a display means is provided to indicate when said touch probes are in contact with said object.

24. Apparatus as claimed in claim 16 wherein said means for determining the perpendicular distances of said first and second locations on opposing sides of said object from said first centerline comprises a pair of touch probes adapted to move perpendicularly with respect to said first centerline.

25. Apparatus as claimed in claim 24 wherein said touch probes are provided with displays indicating their distance from the first centerline.

26. Apparatus as claimed in claim 24 wherein said touch probes are adapted for movement in a direction parallel to said first centerline.

* * * * *